United States Patent [19]

Hirano

[11] Patent Number: 4,526,252

[45] Date of Patent: Jul. 2, 1985

[54] ELEVATOR HOIST UNIT

[75] Inventor: Yasutaka Hirano, Inazawa, Japan

[73] Assignee: Mitsubishi Denki Kabushiki Kaisha, Japan

[21] Appl. No.: 621,456

[22] Filed: Jun. 18, 1984

[30] Foreign Application Priority Data

Jun. 22, 1983 [JP] Japan ..... 58-96322

[51] Int. Cl.[3] ..... B66B 11/08

[52] U.S. Cl. ..... 187/20; 74/421 A

[58] Field of Search ..... 187/20, 17; 74/421 A, 74/421 R, 664, 665 R, 665 F, 670, 411.5, 413; 192/2

[56] References Cited

U.S. PATENT DOCUMENTS

| | | | |
|---|---|---|---|
| 2,149,629 | 3/1939 | Rattigan | 187/2 |
| 2,188,766 | 1/1940 | Buckley | 188/137 |
| 4,322,712 | 3/1982 | Yoshida | 340/19 R |
| 4,422,531 | 12/1983 | Ohtomi et al. | 187/20 |
| 4,433,755 | 2/1984 | Ohtomi | 187/20 |

FOREIGN PATENT DOCUMENTS

| | | |
|---|---|---|
| 57-107782 | 8/1981 | Japan . |
| 57-574 | 1/1982 | Japan . |

*Primary Examiner*—Joseph J. Rolla
*Assistant Examiner*—Nils E. Pedersen
*Attorney, Agent, or Firm*—Leydig, Voit, Osann, Mayer and Holt, Ltd.

[57] ABSTRACT

An elevator hoist unit installed within a machine room disposed in the vicinity of a hoistway for moving an elevator car travelling along the hoistway comprising an electric motor, a reduction gear device having a rotatable input shaft connected to the electric motor and an output shaft for outputting at a reduced rate of rotation compared to the input shaft. The reduction gear device includes a gear for increasing the rotational speed of an auxiliary shaft connected to the gear and having an end projecting outwardly of the reduction gear device. The unit further comprises a brake wheel fixedly mounted on the projecting end of the auxiliary shaft, and braking system disposed about the brake wheel for braking or releasing the brake wheel.

7 Claims, 4 Drawing Figures

ELEVATOR HOIST UNIT

BACKGROUND OF THE INVENTION

This invention relates to elevator hoist units and more particularly to improvements in hoist units for moving an elevator car.

In a typical elevator system a hoist unit is disposed in a machine chamber of an elevator system. The rotation of the hoist motor is transmitted to a drive sheave after the rotating speed is decreased to a suitable speed by means of a speed reduction gear having parallel shaft spur gears to move the elevator car and a counter weight up and down as disclosed in Japanese Utility Model Laid-Open No. 56-107782.

FIGS. 1 to 3 illustrate one example of a conventional elevator hoist unit of the type described above. As is well known, a conventional elevator hoist unit comprises an electric hoist motor 10 mounted on a machine bed 12 disposed on the floor 14 of a machinery chamber 16 which may be a penthouse of a building. The rotary output shaft 18 of the motor 10 has mounted thereon a coding disc 20 and a brake drum 22. Around the brake drum 22 are a pair of brake shoes 24 of an electromagnetic brake 26 mounted on the machine bed 12. The electromagnetic brake 26 comprises an electromagnetic 28 and springs 30 which are used to actuate the brake shoes 24. The rotary output shaft 18 of the motor 10 is connected at its end portion to an input shaft of a speed reduction gear unit 32 also mounted on the machine bed 12, and an output shaft 34 of the reduction gear unit 32 has mounted thereon a drive sheave 36 around which a main rope 38 is wound. One end of the rope 38 is fastened to an elevator car 40 and the other end of the rope 38 is wound around a guide sheave 42 and fastened to a counter weight 44. At its end opposite from the reduction gear unit 32, the rotary shaft 18 of the hoist motor 10 is provided with an engaging surface 46, such as a notch or notches formed in the end face of the shaft 18. This engaging surface 46 receives therein or engages with a complementary-shaped engaging end portion of a manually-operable handle so that the shaft 18 may be manually rotated during maintenance or during a power failure. As shown in FIG. 3, the speed reduction gear unit 32 comprises a pinion gear 48, which is secured on an input shaft 50 rotatably supported by bearings 52 disposed in a gear casing 54, and a spur gear 56 which is mounted on the output shaft 34 rotatably supported by bearings 58.

As is well known, as the drive sheave 36 is driven by the hoist motor 10, the elevator car 40 travels up or down the hoistway. When the car 40 is to be stopped at a floor of the building, the hoist motor 10 and the electromagnetic brake 26 are de-energized so that the brake shoes 24 are pressed against the brake drum 22 by the springs 30. When the motor 10 is energized, the electromagnetic 28 of the brake 26 is also energized, so that the brake shoes 24 are separated from the brake drum 22 against the action of the springs 30 due to the action of the energized electromagnetic 28.

The above-described conventional elevator hoist unit has several disadvantages.

The braking capacity is mainly determined by the net torque on and an inertial moment of the braking shaft. Therefore, when the unbalanced torque and the hoisting load on the output shaft 34 of the reduction gear unit 32 are large and the reduction gear ratio is small, a large braking effort is required and a large-sized brake 26, which includes large components such as the brake shoes 24, the electromagnetic 28, the springs 30, and brake levers, is necessary. This increases the cost of the brake unit 26. Sometimes, a hoist motor assembly including a bulky electromagnetic brake 26 cannot be installed within a small machine chamber 16.

Since the torque on the input shaft 18 is smaller than that of the output shaft 34 by an amount corresponding to the amount of speed reduction, it is sometimes difficult for maintenance and inspection personnel to manually operate with a handle the input shaft 18 of a machine of a low speed reduction ratio due to the torque on the input shaft 18 being too large.

Since the accuracy of speed detection depends on the number of rotations per unit time of the coding disc 20, motor speed control is difficult in a machine with a low rpm input shaft 18.

SUMMARY OF THE INVENTION

Accordingly, an object of the present invention is to provide an elevator hoist unit that is compact and less expensive than conventional elevator hoist units.

Another object of the present invention is to provide an elevator hoist unit that has a small braking unit.

Still another object of the present invention is to provide an elevator hoist unit in which motor speed control can be easily achieved.

Still a further object of the present invention is to provide an elevator hoist unit that can be easily manually operated by inspection personnel.

With the above objects in view, an elevator hoist unit of the present invention comprises an electric motor, a reduction gear means having a rotatable input shaft connected to the electric motor and an output shaft for outputting at a reduced rate of rotation compared to the input shaft. The reduction gear means includes a gear for increasing the rotational speed of an auxiliary shaft which is connected to the gear and has an end projecting outwardly from the reduction gear means compared to the rotational speed of the input shaft. The unit further comprises a brake wheel fixedly mounted on the projecting end of the auxiliary shaft, and braking means disposed about the brake wheel for braking or releasing the brake wheel.

BRIEF DESCRIPTION OF THE DRAWINGS

The present invention will now be described in conjunction with the preferred embodiment thereof shown in the accompanying drawings, in which.

DESCRIPTION OF THE PREFERRED EMBODIMENT

Figure 4:
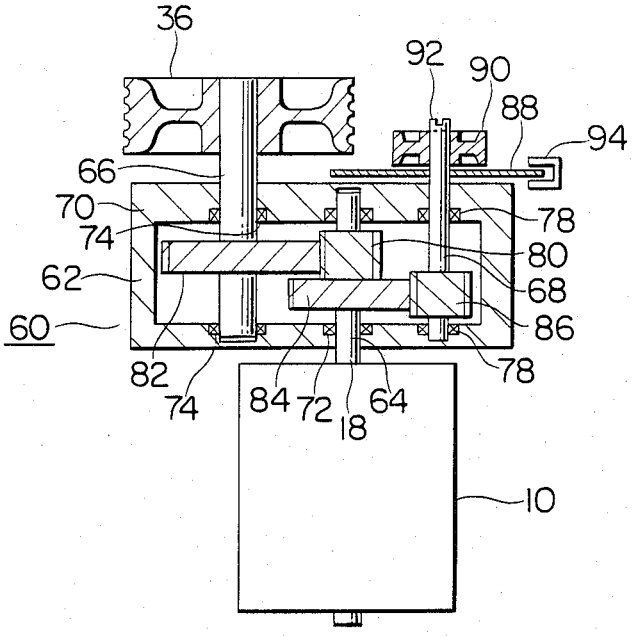
FIG. 4 is a horizontal sectional view of a speed reduction gear unit of the present invention taken along the central axis of the input and output shafts of the unit.

FIG. 4 illustrates an embodiment of the elevator hoist unit constructed according to the present invention in the form of a sectional view taken along a plane defined by the central axes of the rotary input and output shafts.

The elevator hoist unit 60 of the present invention comprises a speed reduction gear unit 62 which has an input shaft 64 connected to or made integral with the output shaft 18 of the hoist motor 10, an output shaft 66 connected to the driving sheave 36, and a third auxiliary rotating shaft 68 which will be described in more detail later. These shafts 64, 66, and 68 are rotatably supported in a gear casing 70 of the unit 62 by bearings 72, 74, and 78, respectively. The input shaft 64 has mounted thereon a pinion gear 80 which engages a spur gear 82 mounted on the output shaft 66, so that the rate of rotation of the input shaft 64 is reduced according to the gear ratio of these gears 80 and 82 to drive the drive sheave 36 at a desired reduced speed. The input shaft 64 also has mounted thereon a spur gear 84 concentric with the pinion gear 80. This second spur gear 84 meshes with a smaller-diameter pinion gear 86 secured to the auxiliary shaft 68, one end of which extends through the gear casing 70. Thus, while the first gear pair 80 and 82 reduces the rotational speed, the second gear pair 84 and 86 increases the rotational speed.

The extended end of the auxiliary shaft 68 has mounted thereon a coding disc 88 and a brake drum 90, and an engaging surface 92 is formed on the end face thereof. The coding disc 88 is a disc having signal generating elements, such as holes, around its periphery for allowing pulse signals to be detected by a detector 94 positioned in the vicinity of the disc 88 for detecting the rotational speed of the disc and therefore of the elevator car 40 by counting the number of pulses per unit time. The detected rotational speed of the disc 88 is utilized in controlling the operation of the elevator system. Although not illustrated, brake shoes, an electromagnetic, springs, etc. are positioned around the brake drum 90, thereby constituting an electromagnetic brake unit on the extended end of the shaft 68. The engaging surface 92, such as a notch or notches formed in the end face of the shaft 68, receives therein or engages with a complementary-shaped engaging end portion of a manually operable handle (not shown) so that the shaft 68 may be manually rotated during maintenance or during a power failure.

Figure 1:
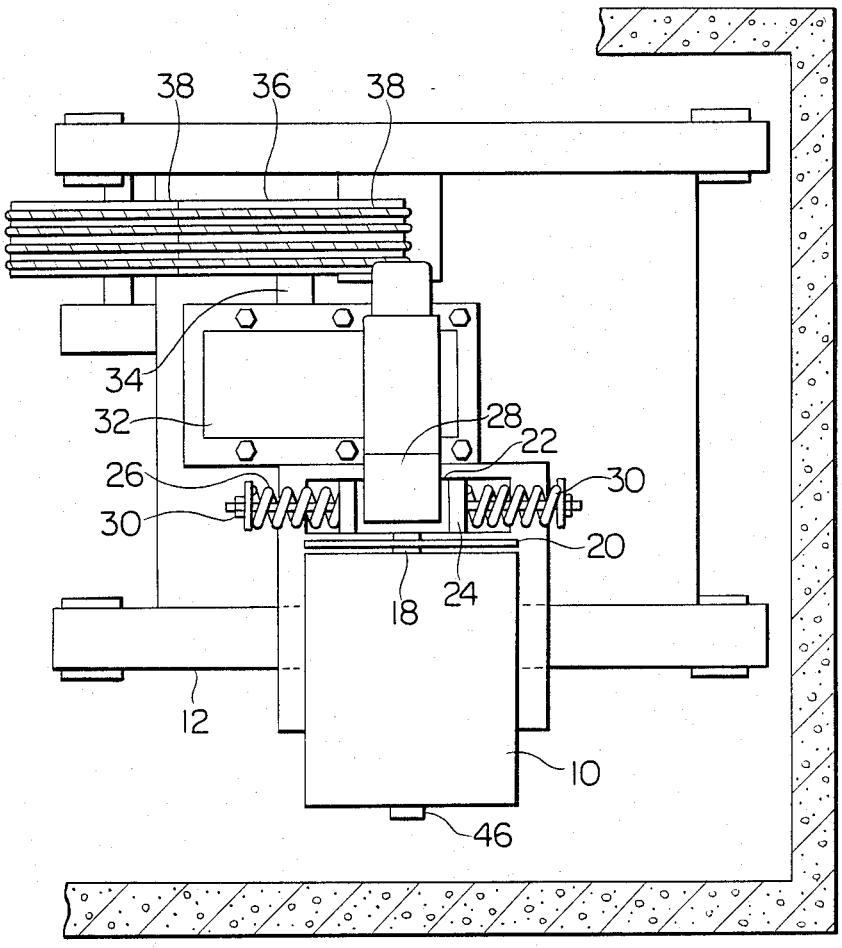
FIG. 1 PRIOR ART
FIG. 1 is a plan view of an elevator hoist unit of the conventional design installed in a machine room above an elevator hoistway.
Figure 2:
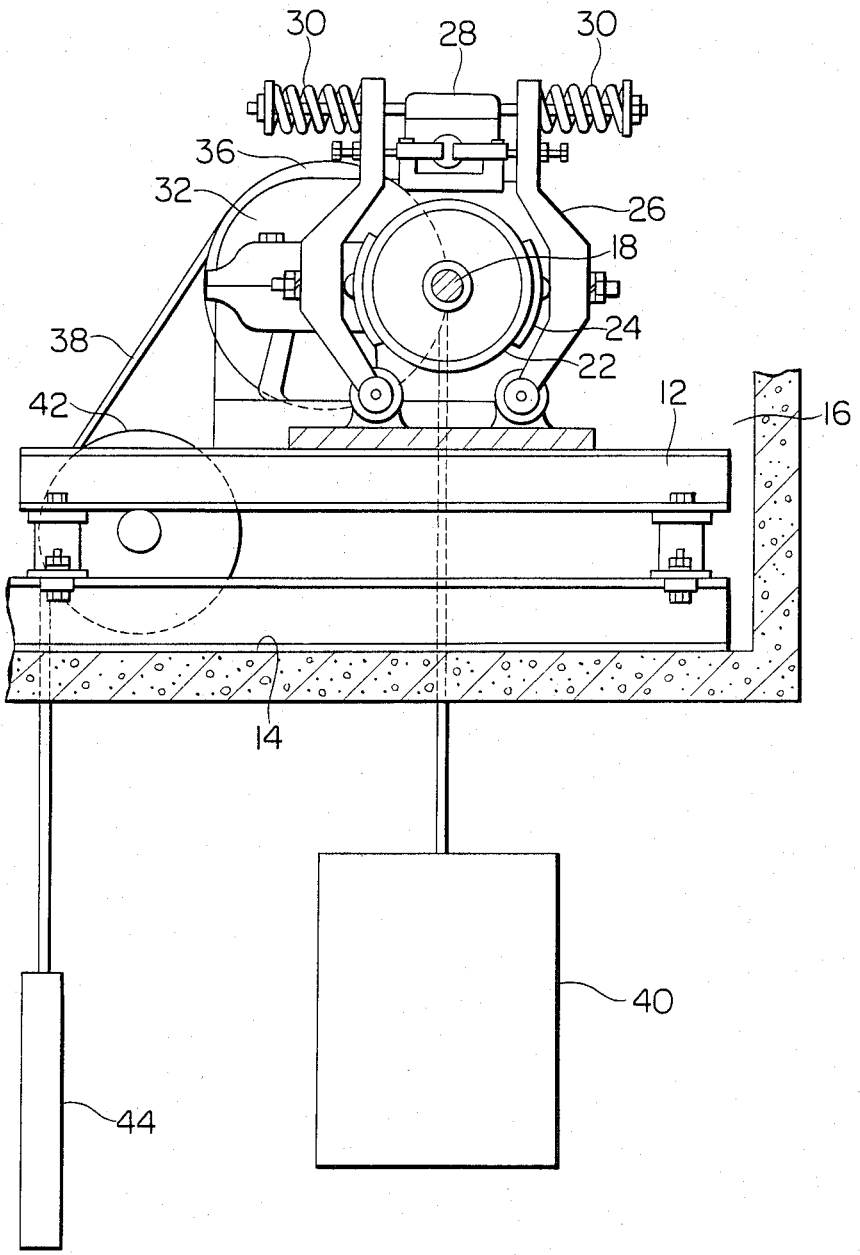
FIG. 2 PRIOR ART
FIG. 2 is a side view of the elevator hoist unit shown in FIG. 1 with an electric motor removed.
Figure 3:
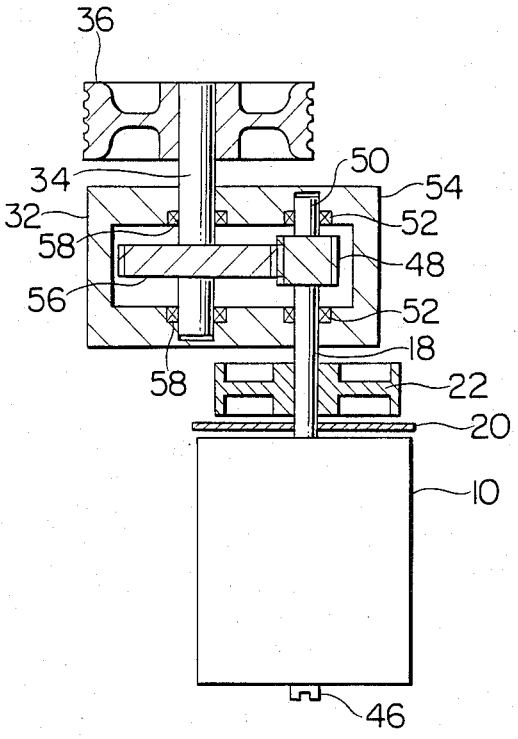
FIG. 3 PRIOR ART
FIG. 3 is a horizontal sectional view of a conventional speed reduction gear unit taken along the central axis of the input and the output shafts.

In an elevator hoist unit 60 constructed as above described, the auxiliary shaft 68 and therefore the brake drum 90 rotate at a much higher speed than the motor output shaft 18 or the brake drum 22 of the conventional hoist unit illustrated in FIGS. 1 to 3 because of the speed-increasing gear pair 84 and 86. The speed increasing ratio of the gear pair 84 and 86 is preferably between 1.5 and 4, taking the dimensions of the hoist unit and braking capacity into consideration. Therefore, the torque on the auxiliary shaft 68 and accordingly the braking effort required to be applied on the brake drum 90 to stop the elevator car 40 is much smaller than that required in the hoist unit of the conventional design and is between 1/1.5 and $\frac{1}{4}$ of that of the conventional design. Also, the radius of the brake drum 90 can be from 1/1.5 to $\frac{1}{4}$ of that of a conventional design. Thus, the overall dimensions of the brake unit can be smaller and the installation of the electromagnetic brake unit in a narrow machine room is possible. Also, since the torque on the auxiliary shaft 68 is small, the manual rotation of the shaft with a handle is much easier and quicker. Further, as the rotational speed of the auxiliary shaft 68 on which the coding disc 88 is mounted is higher, the detection of the rotational seed is more accurate than that in the conventional design.

What is claimed is:

1. An elevator hoist unit installed within a machine chamber disposed in the vicinity of a hoistway for moving an elevator car travelling along the hoistway comprising:

(a) an electric motor;

(b) a reduction gear means having a rotatable input shaft connected to said electric motor and an output shaft rotated at a reduced rate of rotation compared to said input shaft, a high speed auxiliary shaft, said reduction gear means further including a gear for increasing the rotational speed of said high speed auxiliary shaft compared to the rotational speed of said input shaft, said auxiliary shaft being connected to said gear and having an end projecting outwards from said reduction gear means;

(c) a brake wheel fixedly mounted on said projecting end of said auxiliary shaft; and (d) braking means disposed about said brake wheel for braking or releasing said brake wheel.

2. An elevator hoist unit as claimed in claim 1, wherein said projecting end of said auxiliary shaft extends through said brake wheel, and said projecting end has formed therein an engaging portion with which a manual handle engages during manual operation of the elevator hoist.

3. An elevator hoist unit as claimed in claim 1, wherein said electric motor is disposed on one side of said speed reduction gear means, and said high speed auxiliary shaft projects from a second side of said speed reduction gear means opposite from said one side, said brake wheel being connected to said end projecting on said second side.

4. An elevator hoist unit as claimed in claim 1, wherein said projecting end of said high speed auxiliary shaft has mounted thereon a rotary disc for detecting the rotating speed of said electric motor.

5. An elevator hoist unit as claimed in claim 4, wherein said rotary disc is disposed between said speed reduction gear means and said braking wheel.

6. An elevator hoist unit as claimed in claim 1, wherein said one end of said output shaft projects from said speed reduction gear means and has mounted thereon a rope sheave around which a main rope for supporting the car is connected, and said projecting end of said output shaft and said projecting end of said high speed auxiliary shaft project on the same side with respect to said speed reduction gear means.

7. An elevator hoist unit as claimed in claim 1, wherein said output shaft and said high speed auxiliary shaft are disposed on opposite sides of said input shaft.

* * * * *